United States Patent [19]

Pak

[11] 4,027,344

[45] June 7, 1977

[54] ENERGY CONSERVING BED WARMING DEVICE

[76] Inventor: Kyoungsik Pak, 221 Holly Drive, King of Prussia, Pa. 19406

[22] Filed: Feb. 23, 1976

[21] Appl. No.: 660,064

[52] U.S. Cl. ..... 5/347; 5/284

[51] Int. Cl.[2] ..... A47G 23/00

[58] Field of Search ..... 219/217, 365, 378, 530, 219/540; 126/205; 5/284, 347

[56] References Cited

UNITED STATES PATENTS

| | | | |
|---|---|---|---|
| 996,350 | 6/1911 | Lamb | 219/45 |
| 1,793,005 | 2/1931 | Oatway | 219/341 |
| 2,031,882 | 2/1936 | Freeman | 219/341 |
| 2,160,443 | 5/1939 | Schadell | 5/319 X |

*Primary Examiner*—Paul R. Gilliam
*Assistant Examiner*—Andrew M. Calvert
*Attorney, Agent, or Firm*—Robert B. Frailey

[57] ABSTRACT

A portable energy conserving bed warming device is provided, designed to store heat and to permit its gradual radiation over an extended period of time. The device is placed at the foot of the bed, under the bed covers, and radiates heat to warm the bed and provide for comfortable sleeping in cold weather. It includes a hollow container made of a heat conductive material to provide a reservoir for heated fluid. The fluid is placed in the container and heated, following which the container is closed. The container is snugly enclosed within a hollow heat insulating casing closed on all sides except for a plurality of selectively disposed openings in the front wall. The openings in the casing permit heat radiating from the heated fluid in the reservoir to pass slowly into the ambient atmosphere, thereby warming the bed in which the device is placed. To enhance radiation of heat from the heated fluid reservoir, some of the walls of the container are provided with indentations or corrugations to increase its heat transfer surface. The casing for the device contains heating means for heating the fluid in the reservoir.

9 Claims, 4 Drawing Figures

ENERGY CONSERVING BED WARMING DEVICE

SUMMARY OF THE INVENTION

This invention comprises an improved device for the economic and energy conserving heating of a bed during sleeping in cold weather. More particularly, the invention comprises a portable heat containing device which is designed to gradually radiate or emit heat from a reservoir of heated fluid into a bed, to maintain its occupant warm and comfortable throughout a cold night. The reservoir of heated fluid includes an especially designed container adapted to enhance the radiation of heat from the fluid. The invention also includes a specially designed heat insulating casing adapted to permit heat to radiate, or escape, from the device at a gradual rate over an extended period of time. Heating means are provided to heat the fluid after it has been placed into the container from any suitable external source of heating energy.

The primary object of the invention is to provide a highly economic, energy conserving bed warming device which will keep a bed warm, and its occupant comfortable, during a cold night of sleeping.

A further object of the invention is to provide an energy conserving bed warming device which will retain heat over a long period of time and will radiate or emit the heat at a gradual rate over an extensive period to time, and thereby provide for warm and comfortable sleeping in cold weather over the entire night.

A further object is to provide an especially designed bed warming device which not only conserves energy, but also conserves the emission of heat from a reservoir of heated fluid, whereby heat is radiated from the device into the ambient atmosphere continuously over an extended period of time.

A further object is to provide a highly economical, low cost energy conserving device, which retains heat for a long period of time and provides warmth and comfort during sleeping in cold weather.

Other objects and advantages of the invention will be readily apparent from the following description of a preferred embodiment thereof, reference being had to the accompanying drawing.

DESCRIPTION OF THE FIGURES IN THE DRAWING

DETAILED DESCRIPTION OF THE INVENTION

Figure 1:
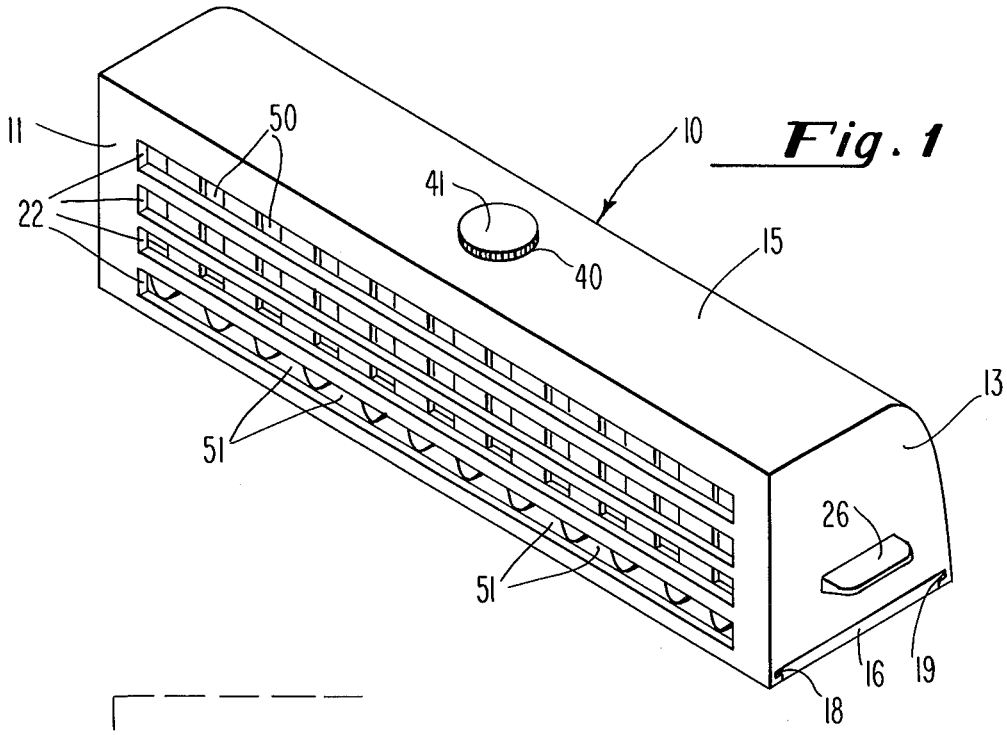
FIG. 1 is a view in front perspective, showing a preferred bed warming device of this invention.

Referring to the preferred device of this invention shown in the drawing, there is illustrated an external hollow casing 10 composed of heat insulating material, preferably of a plastic or cellulose composition. The casing 10 comprises elongated spaced front and rear walls 11, 12, spaced side walls 13, 14, a top wall 15 and a detachable lid 16, the latter comprising the casing bottom.

Figure 2:
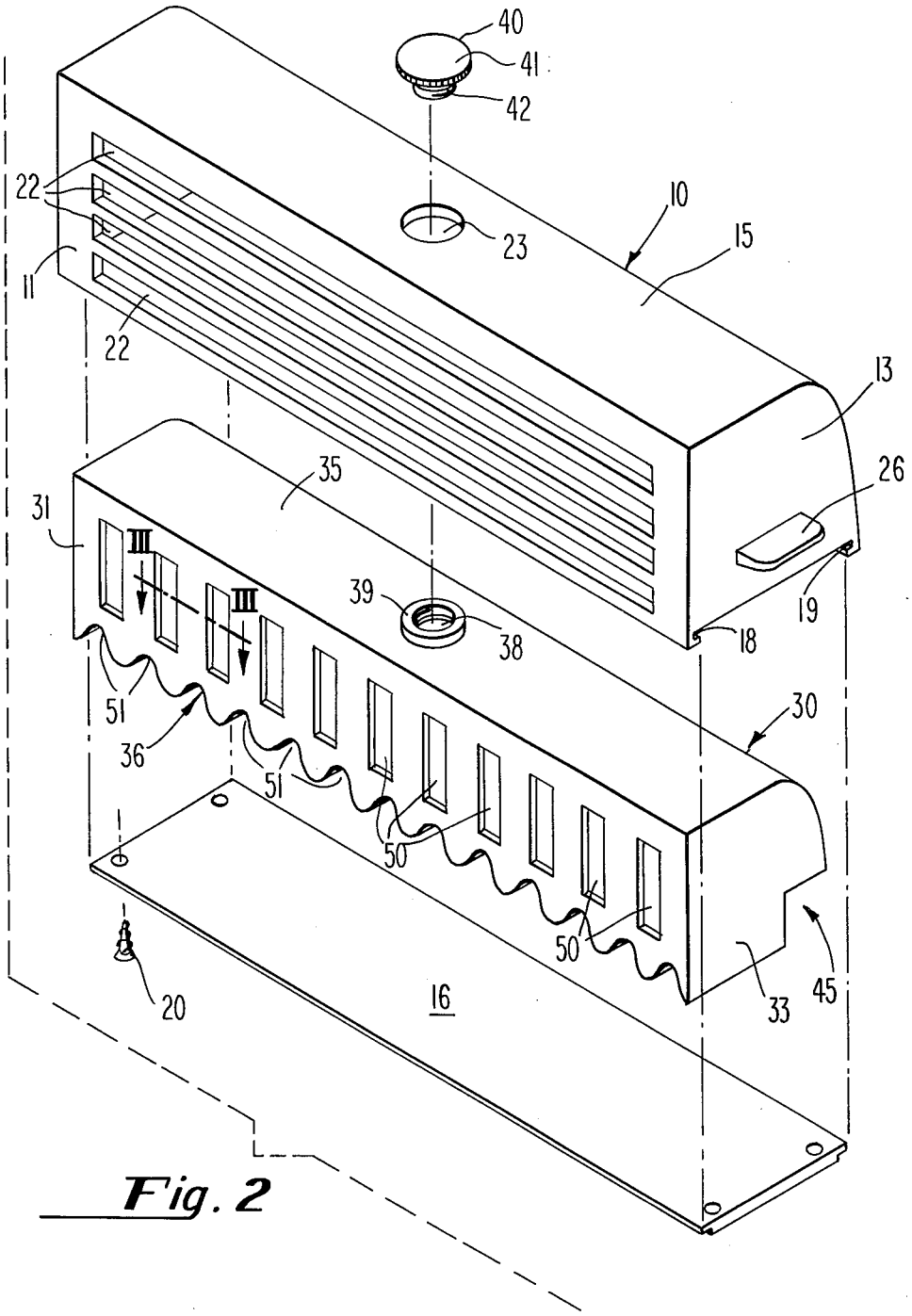
FIG. 2 is an exploded view of the device in front perspective.

Disposed adjacent the bottom edges of the front and rear walls 11, 12 are a pair of opposing elongated grooves or slots 18, 19, for the slidable reception of the lid or bottom panel 16 of the casing 10. The slidable lid 16 is retained in place, to complete the closure of the casing 10, by any suitable securing means, such as screws 20 (FIG. 2).

Figure 4:
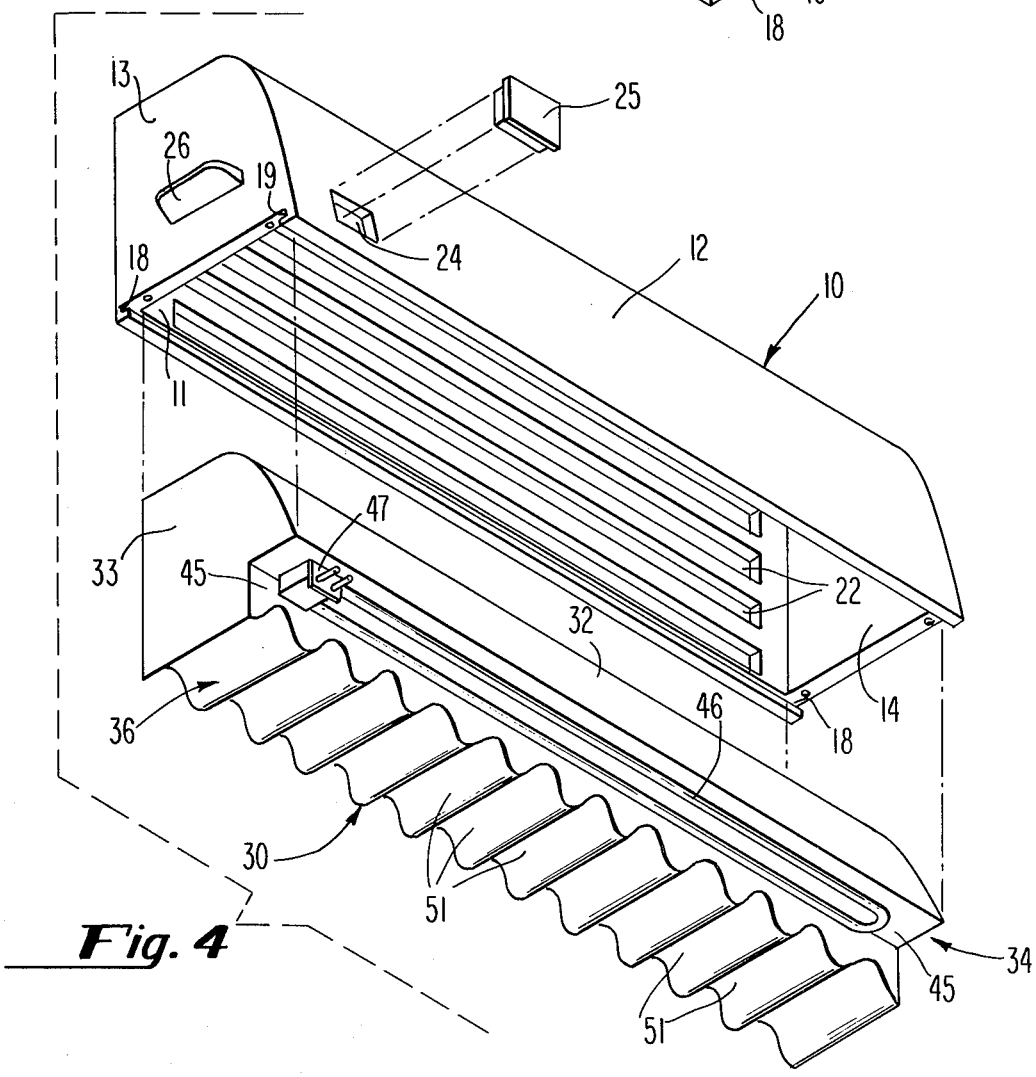
FIG. 4 is an exploded view in perspective of the back of the device, with the bottom panel or lid omitted.

Preferably, the front and rear walls 11, 12, the side walls 13, 14 and the top wall 15 of the heating insulating casing 10 are integrally formed into a single hollow unit. The bottom of the casing, composed of the slidable lid 16, when properly in place, completes its structure. The front face or wall 11 of the casing 10 is provided with a plurality of spaced openings 22 of selected size and dimension. An aperture 23 (FIG. 2) is formed in the top wall 15 of the casing, and a second aperture or opening 24 (FIG. 4) is formed in the rear wall thereof. The later aperture is provided with a snugly fitting closure 25, to seal the rear wall 12. To enhance the portability of the device, handles, such as handle 26 mounted on side 13 of the casing 10, may be provided. A similar handle (not shown) may be disposed on side 14.

Snugly disposed within the hollow of the casing 10 is a hollow closeable container 30, formed of a heat conductive, rust-resistant material, such as aluminum. The container may be composed of any suitable lightweight material, provided it is resistant to rust and corrosion, and has a relatively high heat conductive capacity. The hollow container 30 is provided with elongated spaced front and rear walls 31, 32, spaced side walls 33, 34 and elongated spaced top and bottom walls 35, 36. The container 30 is designed to receive and hold fluid-tight any fluid, such as water, capable of being heated readily to its boiling point. An opening 38 is formed in the top 35 of the container 30 permits fluid to be deposited in and removed from the container. Preferably, the opening 38 is in the form of an internally threaded neck 39 extending upwardly from the top surface of wall 35 of the container, into the aperture 23 of the top wall 15 of the casing 10. The openings 38 and 23 should be co-axial. A closure 40 is provided for the neck opening 39. The closure 40 is composed of a cap 41 from which depends an externally threaded stem 42, which engages threadingly within the neck 39 to seal the container opening 38. When the closure 40 is securely engaged threadingly within the neck opening 39, its cap 41 engages snugly against the top surface 15 of the casing 10 (FIG. 1).

Formed externally of the container 30, along its rear portion, is an elongated recess 45. The recess 45 is disposed adjacent the bottom portion of the rear wall 12 of the casing 10, and above its bottom 16. When the heating device is assembled, with bottom 16 in place, the recess 45 takes the form of an elongated hollow space. Disposed within the recess is a heating element 46 for heating the fluid or water which is contained within the reservoir 30. Preferably, the heating means 46 comprises an electrical heating device, such as an electrical resistance element, electric cable, or the like. The heating element 46 is secured to the outside surface of the container 30 by any suitable means, such as welding. When the heating means takes the form of an electrical heating device, it is provided with a connector or plug 47 (FIG. 4) which extends into the opening 24 in the rear wall 12 of the casing 10. Upon removal of the detachable cap 25, the electrical connector or plug 47 may be connected by an electrical cord to any external source of electric power.

Figure 3:
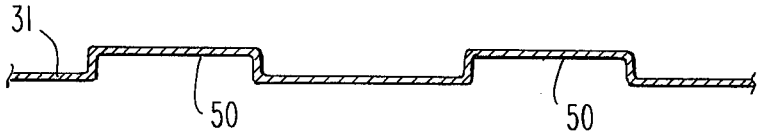
FIG. 3 is a view in section taken along the line III-III of FIG. 2.

In the preferred embodiment of the invention, the elongated front wall 31 of the container 30 is provided with spaced indentations 50. Preferably, although not necessarily, the indentations 50 may be of rectangular configuration and cross-section (FIGS. 2 and 3). Similarly, the bottom 36 of the container 30 is formed with spaced indentations 51. In the preferred arrangement shown, the container bottom 36 is corrugated, with the grooves of the corrugations forming the indentations 51.

In use, the bed warming device of this invention, illustrated by way of example in FIGS 1–4, is assembled with the elongated reservoir or container 30 snugly engaged within its elongated casing 10, with the detachable lid 16 firmly secured in place. The cap 40 is removed from the neck opening 39, and the container is filled with water to approximately 90% of its volume. With the lid or cap 40 still removed, the heating means 46 is connected to a suitable source of energy, such as an external electric outlet, and the water in the container 30 is heated almost to its boiling point. Thereupon, the heating means 46 is disconnected from its external source of energy, and the closures 25, 40 are snugly engaged within their openings 24, 38, respectively, The device then is placed in a bed in a location where it may be adjacent to, or in contact with the feet of a sleeper.

Because of the heat insulating nature of the hollow casing 10, provided with openings 22 of selected or limited size, heat from the heated water in the reservoir or container 30 will be radiated or emitted slowly from the device, through its openings 22, all during the night, to maintain the sleeper warm and comfortable in bed. The indentations 50, 51 formed in the front and bottom walls 31, 36 of the elongated container 30 provide additional heat conducting surfaces, to enhance the discharge of heat from the heated fluid through the walls of the container 31. The heat radiates through the openings 22 at a gradual rate into the ambient atmosphere in which the bed warming device is located.

In practice, it is preferred that the container 30 have a fluid capacity of from one-half gallon to two one-half gallons. However, the fluid volume capacity of the container 30 is a matter of choice, depending on the conditions and environment in which the bed warming device of this invention is to be utilized. The openings 22 should be carefully selected as to size and dimension to permit heat to escape from the bed warming device at a gradual rate over an extended period of time.

If desired, the screwed plug 40 may be provided with a suitable gasket (not shown) to ensure against leakage of fluid from the container 30. The heat insulating casing 10 not only ensures that heat discharged from the heated reservoir of fluid within the container 30 is emitted gradually, over an extended period of time, into the ambient atmosphere, but also protects the sleeper's feet from being burned by the hot wall of the container.

By reason of the arrangement and structure illustrated and described, the heated water within the container 30 will remain warm all during the night. The next morning, the water will be relatively warm, and if desired, may be utilized for washing the person of for other suitable means, such as household cleaning. Thus, the invention provides not only warmth and comfort during sleeping, but permits conservation of both energy and water. It permits a warm bed to be provided in a chilly or cold environment, or in a room where heat has been reduced for conservation purposes, while permitting the warm water used as a heating medium to be re-utilized.

Although a preferred embodiment of this invention has been shown and described for the purpose of illustration, as required by Title 35 U.S.C. 112, it is to be understood that various changes and modifications may be made therein, and their uses made thereof, without departing from the spirit and utility of the invention or the scope thereof, as set forth in the appended claims.

I claim:

1. A portable energy conserving warming device for use in a bed comprising:

a. a hollow container of heat conductive material to provide a closed reservoir of heated fluid, b. said hollow container having spaced front and rear walls and spaced top and bottom walls, and spaced side walls each connected to said front, rear, top and bottom walls, c. an opening in the container to permit heatable fluid to be deposited in and removed from the container, d. a closure for the opening, e. a hollow casing of heat insulating material for snugly enclosing the container.

f. said casing including spaced front and rear walls connected by spaced side walls, and having a lid, g. the front, rear and side walls of the casing being disposed, respectively, proximate of the front, rear and side walls of the container, when the container is enclosed within the casing, h. a plurality of openings disposed in one wall of the casing for permitting heat to radiate gradually from heated fluid in the container to the ambient atmosphere and i. a plurality of spaced indentations formed in at least one wall of the container, to enhance the radiation of heat from the heated fluid in the container to the casing wall openings, j. said indentations being disposed adjacent said casing wall openings.

2. The device of claim 1, wherein a. the container has elongated spaced top and bottom walls, b. the bottom wall of the container is corrugated and c. the top wall of the container is provided with the opening for the fluid, d. said opening comprising a hollow neck extending into an opening in the casing.

3. The device of claim 2, wherein a. the container opening comprises a hollow internally threaded neck and b. the closure for the container opening comprises a threaded lid.

4. The device of claim 1 further including heating means disposed within the casing, but externally of the container, to heat the flud in the container.

5. The device of claim 1, wherein a. the container has rigid elongated front, rear, top and bottom walls, to provide an elongated, hollow closed reservoir, b. the elongated front and bottom walls of the container being provided with a plurality of spaced indentations, c. the casing has rigid elongated front and rear walls joined by a rigid elongated top wall, d. the front wall of the casing being provided with a plurality of openings, and e. the openings in the front wall of the casing are located proximate the front and bottom walls of the container, to permit the indentations in said container walls to be in communication with the casing openings.

6. The device of claim 4, wherein a. the container is provided with an external recess for reception of the heating means, b. the heating means comprises an electrical heating element disposed within the recess, said heating element having electrical connection means for connection to a source of electrical energy external of the casing, c. an opening in the casing for providing access to the electrical connection means and d. a removable closure for the opening.

7. The device of claim 6, wherein a. the casing is composed of elongated front and rear walls joined integrally by an elongated top wall and by the side walls, b. the detachable lid is disposed at the bottom of the casing, c. the recess for the heating means extends along the rear wall of the casing and d. the opening for the electrical connection means is disposed in the rear casing wall.

8. The device of claim 4, wherein a. the casing is composed of elongated front and rear walls joined integrally by an elongated top wall and by the side walls, b. the detachable lid comprises the bottom of the casing, c. an elongated recess is formed externally of the container adjacent the bottom of the casing, d. the heating means is disposed within the recess, e. an opening is disposed in the casing to permit the heating means to be connected to an external source of energy and f. a closure for the casing opening is provided.

9. The device of claim 8, wherein a. at least one handle is disposed externally of the casing, b. the container has spaced front and rear walls and spaced top and bottom walls, c. the front and bottom walls of the container being formed with spaced indentations, and d. the container opening is disposed in the top wall of the container, and is co-axial with an opening in the top wall of the casing, e. said opening in the top wall of the casing providing clearance for the closure for the container opening.

* * * * *

UNITED STATES PATENT OFFICE

CERTIFICATE OF CORRECTION

PATENT NO. : 4,027,344

DATED : June 7, 1977

INVENTOR(S) : Kyoungsik Pak

It is certified that error appears in the above-identified patent and that said Letters Patent are hereby corrected as shown below:

Column 2, line 14, change "later" to --latter--

Column 3, line 22, change the comma to a period

Column 3, line 39, after "two" insert --and--

Column 3, line 60, change "of" to --or--

Column 4, line 5, change "their" to --various--

Column 4, line 55, change "flud" to --fluid--

Column 5, line 15, after "wherein" start a new paragraph

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*